US010443606B2

(12) United States Patent
Boutros-Mikhail et al.

(10) Patent No.: US 10,443,606 B2
(45) Date of Patent: Oct. 15, 2019

(54) SIDE-CHANNEL BLOWER FOR AN INTERNAL COMBUSTION ENGINE

(71) Applicant: PIERBURG GMBH, Neuss (DE)

(72) Inventors: Matthias Boutros-Mikhail, Neuss (DE); Rainer Peters, Goch (DE)

(73) Assignee: PIERBURG GMBH, Neuss (DE)

( * ) Notice: Subject to any disclaimer, the term of this patent is extended or adjusted under 35 U.S.C. 154(b) by 203 days.

(21) Appl. No.: 15/541,716

(22) PCT Filed: Dec. 11, 2015

(86) PCT No.: PCT/EP2015/079420

§ 371 (c)(1),
(2) Date: Jul. 6, 2017

(87) PCT Pub. No.: WO2016/110373

PCT Pub. Date: Jul. 14, 2016

(65) Prior Publication Data

US 2018/0017069 A1 Jan. 18, 2018

(30) Foreign Application Priority Data

Jan. 9, 2015 (DE) ..... 10 2015 100 215

(51) Int. Cl.
*F04D 29/30* (2006.01)
*F04D 29/44* (2006.01)
(Continued)

(52) U.S. Cl.
CPC ..... *F04D 29/30* (2013.01); *F01M 13/02* (2013.01); *F04D 23/008* (2013.01);
(Continued)

(58) Field of Classification Search
CPC ..... F04D 23/008; F04D 29/281; F04D 29/30; F04D 29/4206; F04D 29/441; F04D 29/663
See application file for complete search history.

(56) References Cited

U.S. PATENT DOCUMENTS 4,204,802 A * 5/1980 Schonwald ..... F04D 23/008 415/55.1
4,325,672 A 4/1982 Sixsmith et al.
(Continued)

FOREIGN PATENT DOCUMENTS

DE 691 01 249 T2 6/1994
DE 195 18 101 A1 12/1995
(Continued)

*Primary Examiner* — Igor Kershteyn
(74) *Attorney, Agent, or Firm* — Norman B. Thot

(57) ABSTRACT

A side-channel blower for an internal combustion engine includes a flow housing, an impeller which rotates in the flow housing, a housing wall which surrounds the impeller, a drive unit which drives the impeller, impeller blades arranged in a radially outer region of the impeller, a radial gap arranged between the impeller and the housing wall, an inlet, an outlet, two flow channels which connect the inlet to the outlet, and an interruption zone arranged between the outlet and the inlet which interrupts the two flow channels in a peripheral direction. The impeller blades open in a radially outward direction. A respective one of the two flow channels is respectively formed axially opposite to the impeller blades in the flow housing. The impeller blades each comprise a V-shaped cross-section.

7 Claims, 3 Drawing Sheets

(51) Int. Cl.

| | |
|---|---|
| ***F04D 29/66*** | (2006.01) |
| ***F04D 29/42*** | (2006.01) |
| ***F04D 23/00*** | (2006.01) |
| ***F04D 29/28*** | (2006.01) |
| ***F01M 13/02*** | (2006.01) |

(52) U.S. Cl.
CPC ..... *F04D 29/281* (2013.01); *F04D 29/441* (2013.01); *F04D 29/663* (2013.01); *F01M 2013/026* (2013.01); *F04D 29/4206* (2013.01)

(56) References Cited

U.S. PATENT DOCUMENTS

| | | | | |
|---|---|---|---|---|
| 5,281,083 | A | 1/1994 | Ito et al. | |
| 5,299,908 | A | 4/1994 | Robbie | |
| 5,302,081 | A | 4/1994 | Smith | |
| 5,395,210 | A * | 3/1995 | Yamazaki | F04D 23/008 415/55.1 |
| 5,499,502 | A * | 3/1996 | Haniu | F01N 3/22 60/290 |
| 5,527,149 | A | 6/1996 | Moss et al. | |
| 5,762,469 | A | 6/1998 | Yu | |
| 6,422,808 | B1 | 7/2002 | Moss et al. | |
| 6,986,643 | B2 * | 1/2006 | Huang | F04D 29/282 415/206 |
| 7,033,137 | B2 * | 4/2006 | Shufeldt | F04D 23/008 415/119 |
| 2001/0028844 | A1 | 10/2001 | Narisako et al. | |
| 2007/0001604 | A1 | 1/2007 | Lee | |
| 2007/0077138 | A1 * | 4/2007 | Tsuzuki | F04D 29/188 415/55.1 |
| 2007/0160456 | A1 | 7/2007 | Peterson et al. | |
| 2013/0195607 | A1 | 8/2013 | Adhvaryu et al. | |
| 2013/0209247 | A1 | 8/2013 | Herrmann et al. | |
| 2013/0266434 | A1 | 10/2013 | Blackburn | |

FOREIGN PATENT DOCUMENTS

| | | | |
|---|---|---|---|
| DE | 197 44 237 | A1 | 4/1998 |
| DE | 199 55 955 | A1 | 6/2001 |
| DE | 20 2004 019 506 | U1 | 4/2006 |
| DE | 10 2006 000 489 | A1 | 4/2007 |
| DE | 10 2010 046 870 | A1 | 3/2012 |
| EP | 1 672 222 | A2 | 6/2006 |
| EP | 1 672 222 | B1 | 9/2009 |
| JP | S54-47114 | A | 4/1979 |
| JP | H05-240192 | A | 9/1993 |
| JP | 3003357 | B2 | 11/1999 |

* cited by examiner

SIDE-CHANNEL BLOWER FOR AN INTERNAL COMBUSTION ENGINE

CROSS REFERENCE TO PRIOR APPLICATIONS

This application is a U.S. National Phase application under 35 U.S.C. § 371 of International Application No. PCT/EP2015/079420, filed on Dec. 11, 2015 and which claims benefit to German Patent Application No. 10 2015 100 215.9, filed on Jan. 9, 2015. The International Application was published in German on Jul. 14, 2016 as WO 2016/110373 A1 under PCT Article 21(2).

FIELD

The present invention relates to a side-channel blower for an internal combustion engine comprising a flow housing, an impeller that is rotatably arranged in the flow housing, impeller blades that are formed in the radially outer region of the impeller and which open in a radially outward direction, a radial gap between the impeller and a housing wall that radially surrounds the impeller, an inlet and an outlet, two flow channels for a gas which connect the inlet to the outlet and which are formed axially opposite the impeller blades in the flow housing, the ducts being fluidically connected to one another via intermediate spaces between the impeller blades, a drive unit for driving the impeller, and an interruption zone which is located between the outlet and the inlet and in which the flow channels are interrupted in the peripheral direction.

BACKGROUND

Side-channel blowers or pumps have previously been described. In a vehicle, they serve, for example, to convey fuel, to blow secondary air into the exhaust system, or to convey hydrogen for PEM fuel cell systems. The drive is usually effected by an electric motor whose output shaft has the impeller arranged thereon. Side-channel blowers have previously been described in which only one flow channel is formed on an axial side of the impeller in a housing part, as well as side-channel blowers formed with a flow channel on either axial side of the impeller, in which case both flow channels are in fluid communication with each other. In such a side-channel blower, one of the flow channels is most often formed in a housing part which serves as a cover, while the other flow channel is formed in the housing part to which the drive unit is typically mounted, on the shaft of which the impeller is arranged to rotate therewith. The impeller is designed at its periphery so that it forms one or two circumferential vortex ducts together with the flow channel or the flow channels surrounding the impeller.

In side-channel blowers with two axially opposite vortex ducts, the impeller blades are divided axially across a radial section into two sections which are respectively assigned to the opposite flow channel. Pockets are formed between the impeller blades, in which, when the impeller rotates, the fluid conveyed is accelerated by the impeller blades in the circumferential direction, as well as in the radial direction so that a circulating vortex flow is generated in the flow channel. With impeller blades of a radially open design, an overflow from one flow channel to the other most often occurs via the gap between the radial end of the impeller and the radially opposite side wall.

In order to obtain the best possible conveyance or pressure increase, different measures have been taken in conveying gases and liquids which are due to the different behavior of compressible and incompressible or slightly compressible media when they are conveyed.

The generation of noise should be taken into account when conveying in side-channel blowers since acoustically disturbing pressure surges occur at the beginning of the interruption zone immediately after a medium has flowed over each impeller blade because compressed gas is still present in the pockets between the impeller blades, which gas has not been completely expelled via the outlet and is suddenly accelerated against the walls of the interruption zone when it reaches that zone. This causes significantly increased noise emissions.

U.S. Pat. No. 6,422,808 B1 describes a side-channel blower for a compressible fluid to increase conveying pressure comprising an impeller enclosed by a flow housing with two side channels, the flow housing having a fluid inlet and a fluid outlet. Blades are arranged along the periphery of the impeller that extend in an axial and a radial direction and which have a radially inner section inclined oppositely to the direction of rotation of the rotor, as well as a radial outer section inclined in the direction of rotation of the rotor, and which convey fluid from the inlet to the outlet as the rotor rotates. The blades each have a chamfer at the radially inner section.

A side-channel blower is also described in U.S. Pat. No. 5,299,908 B1 whose impeller blades extend straightly in a radial direction, but are inclined towards the opposite side channel with respect to the direction of rotation. A radial partition wall is, however, arranged between these two axial blade parts to prevent an overflow from one duct to the other via the impeller. Only a radially outer part of the blades is further formed opposite the flow channel.

Blades that are inclined and separated from each other in such a manner have also been previously described from an impeller of a side-channel pump for an incompressible medium. This impeller also has a radially limiting side wall.

All these blowers and pumps are not, however, optimal in view of their feed rate and in view of the possible pressure increase, respectively.

SUMMARY

An aspect of the present invention is to provide a side-channel blower with which the feed rate or the feed pressure can be increased further without further increasing the diameter or the rotational speed, where the flow conditions in the flow channels and in the impeller are optimized, and/or with where a lower power consumption of the drive can be provided while maintaining feed rates. An aspect of the present invention is also to provide a blower which is suitable for various applications and feed rates and which has a noise generation which is as low as possible.

In an embodiment, the present invention provides a side-channel blower for an internal combustion engine which includes a flow housing, an impeller comprising a rotary axis and being configured to rotate in the flow housing, a housing wall configured to radially surround the impeller, a drive unit configured to drive the impeller, impeller blades arranged in a radially outer region of the impeller, a radial gap arranged between the impeller and the housing wall, an inlet, an outlet, two flow channels configured to connect the inlet to the outlet and to be fluidically connected to one another via intermediate spaces between the impeller blades, and an interruption zone arranged between the outlet and the inlet. The impeller blades are configured to open in a radially outward direction. A respective one of the two flow channels is respectively formed axially opposite to the impeller blades in the flow housing. The interruption zone is configured to interrupt the two flow channels in a peripheral direction. The impeller blades, as seen from a cross section of a plane on which the rotary axis lies, each comprise a V-shaped cross-section so that, in a direction of rotation of the impeller, the impeller blades extend at an angle from the rotary axis in a direction of the respective one of the two flow channel respectively arranged opposite to the impeller blades.

BRIEF DESCRIPTION OF THE DRAWINGS

The present invention is described in greater detail below on the basis of embodiments and of the drawings in which.

DETAILED DESCRIPTION

Figure 1:
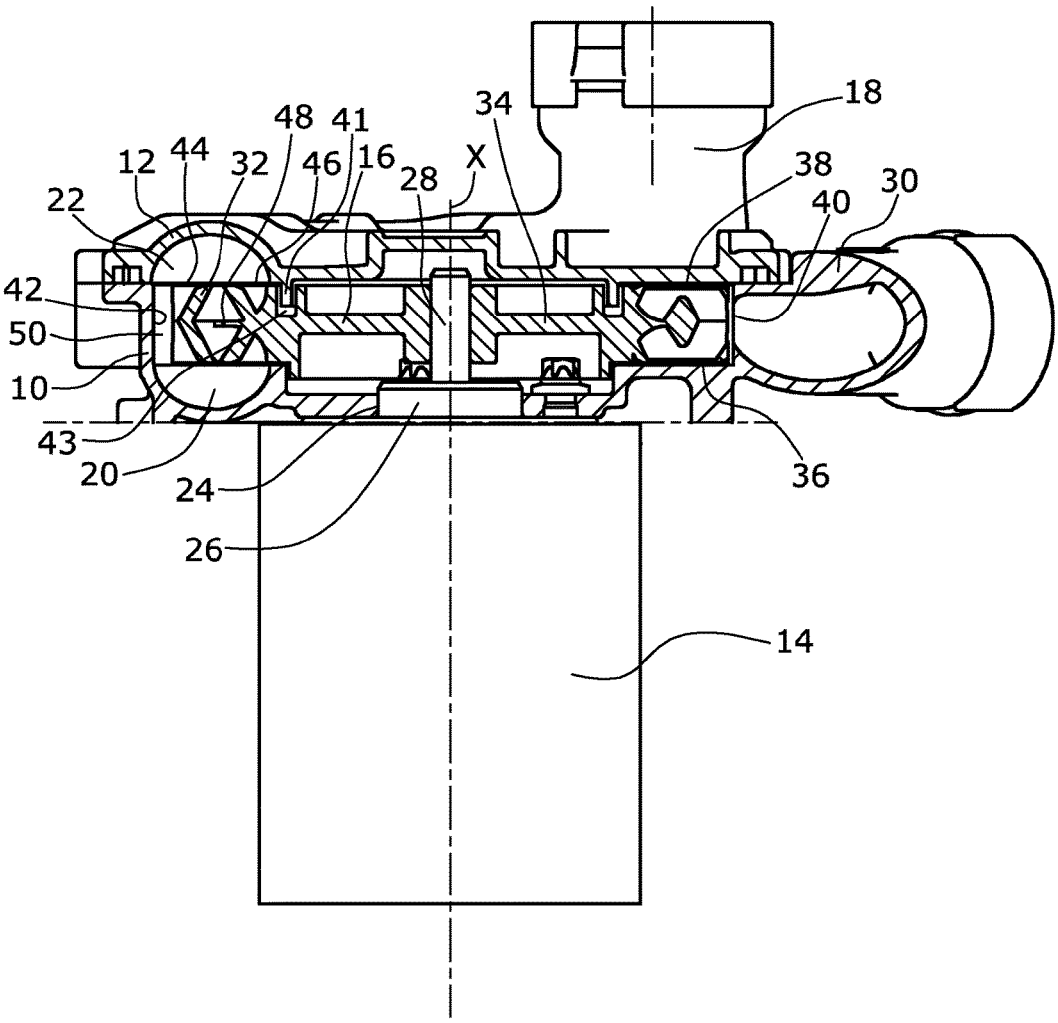
FIG. 1 shows a sectional side view of a side-channel blower according to the present invention.
Figure 2:
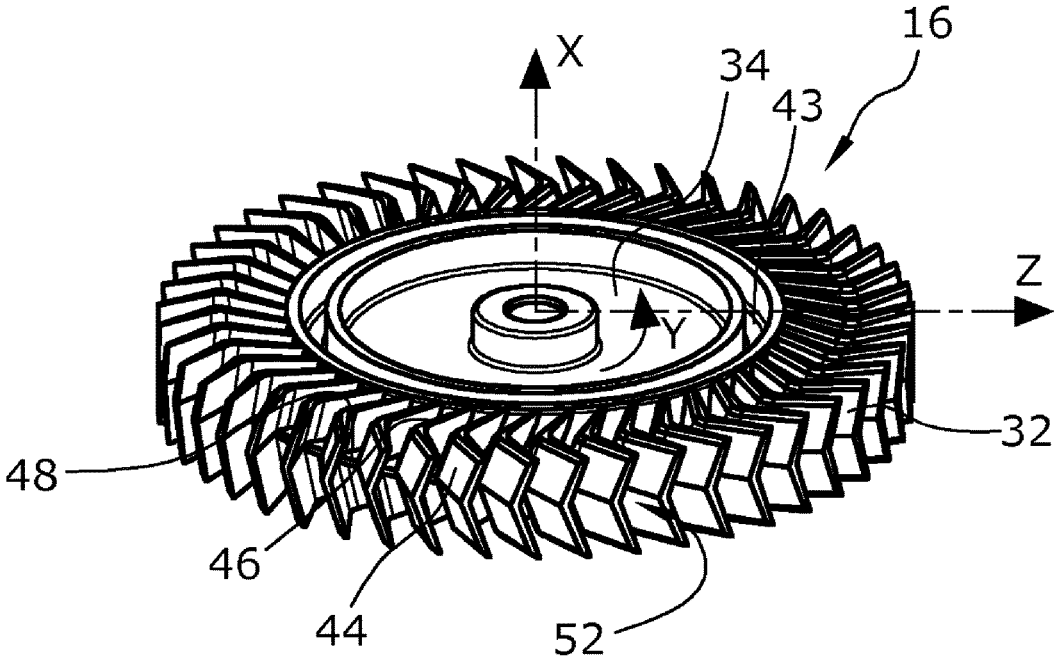
FIG. 2 shows a perspective view of a detail of the impeller of the side-channel blower in FIG. 1.

Contrary to expectations, such an optimization in conveying compressible media is achieved with a side-channel blower in which the impeller blades are formed in a V-shape, as seen in a cross section, so that, with respect to the rotary axis, the impeller blades are inclined in the direction of rotation and extend in the direction of their opposite flow channel. The impeller is at the same time formed to be open both in the axial and the radial direction in the radially outer region so that gas is gathered in the axial center of the blade and is accelerated, which has proven beneficial to the formation of the spiral flow, a constant exchange being possible between the two flow channels. Such a side-channel blower has a higher efficiency and covers a wide range of operating points.

An optimal inclination of the blades with respect to the rotary axis is 5° to 20° in the direction of rotation of the impeller. A particularly high efficiency is obtained with such an angle since an optimal pressure is achieved on the inner side of the blades.

In an embodiment of the present invention, in their radially outer end region, the impeller blades can, for example, be formed so that they are inclined in the direction of rotation of the impeller with respect to the intermediate portion of the impeller blades adjoining the end region on the inner side. An additional acceleration is thereby generated as the medium is moved radially outward, whereby the efficiency is additionally improved.

In an embodiment of the present invention, the radial end region of the impeller blades can, for example, be inclined by 5° to 20° in the direction of rotation with respect to the radial direction, and the adjacent intermediate portion of the impeller blades can, for example, be inclined by 5° to 20° against the direction of rotation with respect to the radial direction. Optimized efficiencies of the blower are obtained with these pitch angles.

In an embodiment of the present invention, the radial gap between the end region of the impeller blades and the housing wall radially surrounding the impeller can, for example, be 0.03 to 0.1 times the impeller diameter in the region of the flow channels. This means that the gap has been significantly reduced compared to known embodiments which, in combination with correspondingly shaped impeller blades, leads to improved results. This is contrary to expectations.

In this embodiment of the impeller, it has additionally proven beneficial if the outlet extends tangentially from the flow channels in the flow housing and has a circular cross section that substantially corresponds to the cross section of the flow channels. This embodiment reduces the noise emissions generated, results in a good discharge of the feed flow and thus also results in high feed rates.

In an embodiment of the present invention, a partition wall can, for example, be formed at the height of the connection between the two legs of the V-shaped impeller blades, which partition wall extends radially over the intermediate region of the impeller blades that adjoins the end region. Pressure losses are thereby prevented that are caused by the two gas flows from the two flow channels axially converging at the radially inner edge of the impeller blades or the flow channels, respectively.

A side-channel blower is thus provided in which, compared to known side-channel blowers for compressible media, the feed rate and/or the possible pressure increase are improved and/or the power consumption is reduced, while the feed rate is maintained, so that the efficiency is improved. A very wide performance range is at the same time covered by a single blower size and noise emissions are reduced.

An embodiment of a side-channel blower according to the present invention is illustrated in the drawings and will be described below.

The side-channel blower illustrated in FIG. 1 has a bipartite flow housing formed by a bearing housing 10 and a housing cover 12 fastened thereto, for example, by screws. An impeller 16 is supported in the bearing housing 10, the impeller 16 being rotatable by a drive unit 14. The compressible medium conveyed reaches the interior of the side-channel blower via an axial inlet 18 formed in the housing cover 12.

The medium then flows from the inlet 18 into two substantially annular flow channels 20, 22, of which the first flow channel 20 is formed in the bearing housing 10 in the central opening 24 of which a bearing 26 of a drive shaft 28 of the drive unit 14 is also arranged, the impeller 16 being fastened on the shaft, and the second flow channel 22 being formed in the housing cover 12. The air leaves via a tangential outlet 30 formed in the bearing housing 10.

The impeller 16 is arranged between the housing cover 12 and the bearing housing 10 and has impeller blades 32 along its circumference, which extend from a disc-shaped central part 34 that is fastened on a drive shaft 28 forming an rotary axis X of the impeller 16, the two flow channels 20, 22 being formed axially opposite the blades.

For a reliable suppression of a short-circuit flow against the direction of rotation Y of the impeller 16 from the inlet 18 to the outlet 30, interruption zones 36, 38 are arranged at the housing cover 12 and at the bearing housing 10 that interrupt the two flow channels 20, 22 so that a gap as small as possible exists in the interruption zones 36, 38 axially opposite the impeller blades 32 of the impeller 16. An interruption zone 40 acting in the radial direction Z is also formed on a radially delimiting housing wall 42 of the housing parts 10, 12 radially delimiting the two flow channels 20, 22.

Figure 3:
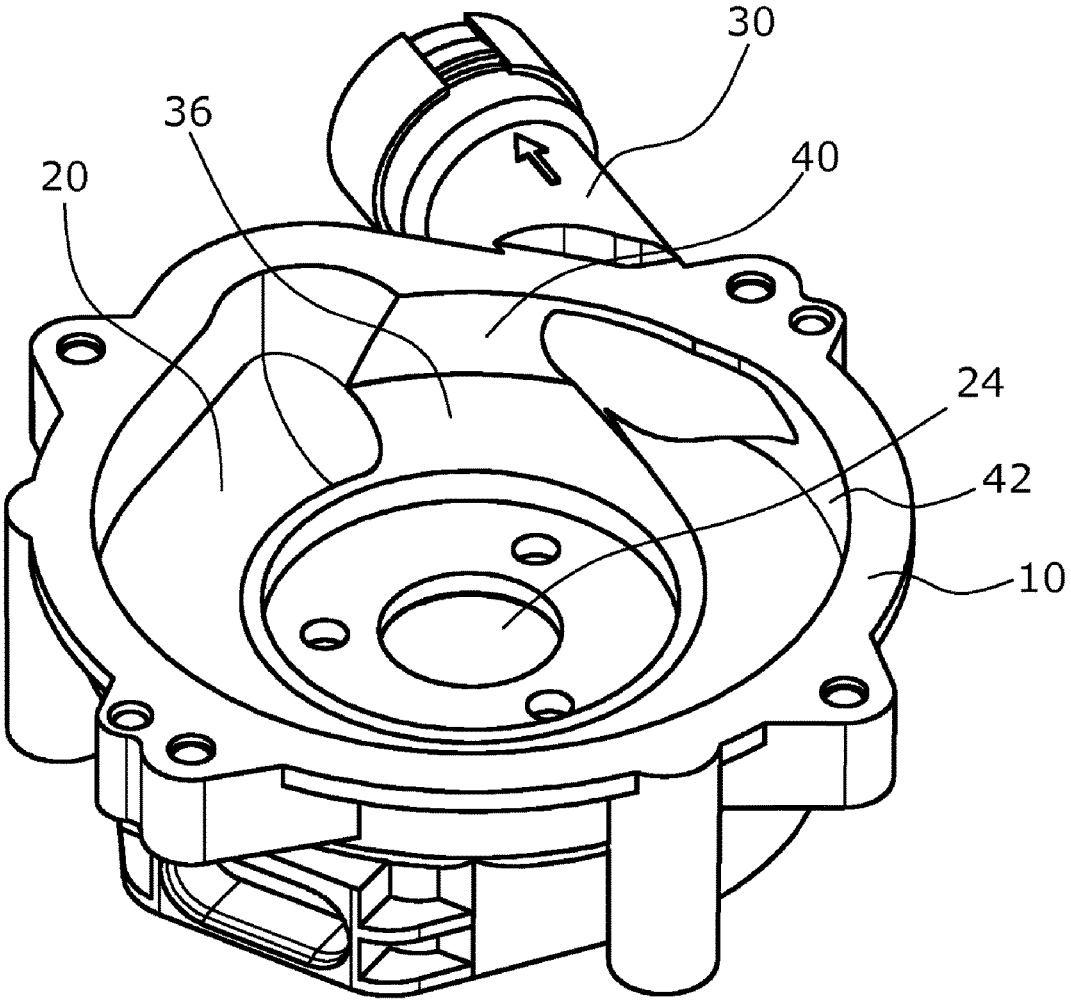
FIG. 3 shows a perspective view of a bearing housing of the side-channel blower in FIG. 1 according to the present invention.

The two flow channels 20, 22 arranged in the bearing housing 10 and in the housing cover 12 have a substantially constant width and extend across the circumference of the housing cover 12 and the bearing housing 10, except for the interruption zones 36, 38, 40. In the view of FIG. 3, the direction of rotation Y of the impeller 16 thus extends counter-clockwise from the beginning of the first flow channel 20 to the end of the first flow channel 20 or to the outlet 30 and then across the interruption zone 36 back to the beginning of the first flow channel 20 that is opposite the inlet 18.

A sealing from the two flow channels 20, 22 to the interior of the impeller 16 is obtained by circumferential corresponding webs 41 and grooves 43 in the housing parts 10, 12 and the disc-shaped central part 34 of the impeller 16.

The impeller blades 32 of the impeller 16 have a radially outer end region 44, as well as a radially adjoining intermediate region 46 arranged between the disc-shaped central part 34 and the radially outer end region 44. In this intermediate region 46, the impeller blades 32 are divided by a radially extending partition wall 48 into a first row axially opposite the first flow channel 20 and a second row axially opposite the second flow channel 22 so that two vortex ducts are formed that are each formed by a respective one of the two flow channels 20, 22 and the part of the impeller blades 32 facing the respective one of the two flow channels 20, 22. No separation exists in the radially outer end region 44 so that in this region an exchange of medium between the two flow channels 20, 22 is possible.

The outer diameter of the two flow channels 20, 22 is slightly larger than the outer diameter of the impeller 16 which is, for example, about 85 mm so that a fluidic connection between the two flow channels 20, 22 also exists outside the outer circumference of the impeller 16. A radial gap 50 of 3 to 6 mm in dimension is thus formed between the radially delimiting housing wall 42 and the radial end of the impeller 16, where a correspondingly larger impeller 16 requires a correspondingly larger radial gap 50 as well. Pockets 52, which are open radially outwards, are thus formed between the impeller blades 32, in which pockets 52 the medium is accelerated so that the pressure of the medium is increased over the length of the two flow channels 20, 22.

The size of the radial gap 50 in particular results with regard to the design of the impeller blades 32 provided by the present invention. In the shown embodiment, the impeller blades 32 are inclined, with respect to the radial direction Z, in the intermediate region 46 by an angle of about 10° against the direction of rotation Y of the impeller 16. In the adjoining radially outer end region 44, the impeller blades 32 are inclined by an angle of 20° in the direction of rotation Y, compared to the intermediate region 46, or the impeller blades 32 extend in this radially outer end region 44 by an angle of 10° in the direction of rotation Y with respect to the radial direction Z. This causes an additional acceleration of the medium during the rotation Y of the impeller 16 at a speed of about 12,000 to 24,000 rpm.

The impeller blades 32 are also V-shaped over their entire substantially radial extension, when seen in cross section, i.e., when cut perpendicularly to the circumferential direction or the direction of rotation Y, so that each leg of each of the impeller blades 32 is assigned to its opposite flow channel 20, 22 and the partition wall 48 is arranged between the legs in the intermediate region 46. Compared to a vector extending in parallel with the rotary axis X, each leg is inclined by about 15° in the direction of rotation Y of the impeller 16 and is formed to extend towards the opposite flow channel 20, 22. In other words: the axial ends of the two legs are each leading with respect to the point at which the two legs join each other.

When the impeller 16 is rotated by the drive unit 14, the gas from the two flow channels 20, 22 enters the pockets 52 in the radially inner intermediate region 46. A maximum accumulation of the gas occurs in the central region of each of the impeller blades 32 due to the rotation and the shape of the impeller blade 32. This accumulated gas is then accelerated outward via the axially central region, the inclination of the radially outer end region 44 generating an additional acceleration exceeding that caused by the normal rotational speed. The gas is accelerated with this pressure towards the radially limiting housing wall 42 which is arranged correspondingly at a greater distance so that a larger space is available for deflection towards the flow channels. The flow channels are then flowed through again from radially outside to the inside. A helical movement is thus obtained along each flow channel from the inlet 18 to the outlet 30. The helical movement has a circular cross section, whereby the cross section available for outflow from a pocket gradually decreases during rotation. This results in low noise generation and only a small gas flow directed along the interruption zone, whereby the efficiency of the blower is improved.

A side-channel blower for compressible media is thus provided which generates high differential pressures and volume flows without an increase in energy requirement so that efficiency is improved compared to known blowers. It is also possible, by merely changing the rotational speed, to reach a number of different operating points with a single blower without causing low efficiencies.

It should be clear that different modifications can be made to the described embodiment of the side-channel blower without leaving the protective scope of the main claim. The drive, the inlet and the outlet, the interruption and outlet contours or the fastening and sealing structures can, for example, be modified. Further modifications are also conceivable. Reference should also be had to the appended claims.

What is claimed is:

1. A side-channel blower for an internal combustion engine, the side-channel blower comprising:

a flow housing;

an impeller comprising a rotary axis and being configured to rotate in the flow housing;

a housing wall configured to radially surround the impeller;

a drive unit configured to drive the impeller;

impeller blades arranged in a radially outer region of the impeller, the impeller blades being configured to open in a radially outward direction;

a radial gap arranged between the impeller and the housing wall;

an inlet;

an outlet;

two flow channels configured to connect the inlet to the outlet and to be fluidically connected to one another via intermediate spaces between the impeller blades, a respective one of the two flow channels being respectively formed axially opposite to the impeller blades in the flow housing; and an interruption zone arranged between the outlet and the inlet, the interruption zone being configured to interrupt the two flow channels in a peripheral direction, wherein, the impeller blades, as seen from a cross section of a plane on which the rotary axis lies, each comprise a V-shaped cross-section so that, in a direction of rotation of the impeller, the impeller blades extend at an angle from the rotary axis in a direction of the respective one of the two flow channel respectively arranged opposite to the impeller blades.

2. The side-channel blower as recited in claim 1, wherein the impeller blades are inclined in the direction of rotation of the impeller by 5° to 20°.

3. The side-channel blower as recited in claim 1, wherein, the impeller blades each comprise a radially outer end region and an intermediate region which adjoins the radially outer end region on a radially inner side of the radially outer end region, and the radially outer end region of each of the impeller blades is formed to be inclined in the direction of rotation of the impeller with respect to the intermediate region.

4. The side-channel blower as recited in claim 3, wherein, the radially outer end region of the impeller blades is inclined by 5° to 20° in the direction of rotation of the impeller with respect to a radial direction, and the intermediate region of the impeller blades is inclined by 5° to 20° against the direction of rotation of the impeller with respect to the radial direction.

5. The side-channel blower as recited in claim 3, wherein, the impeller blades are further configured, as seen in the cross section of the plane on which the rotary axis lies, to comprise a first leg and a second leg which are joined together via a connection, and further comprising:

partition walls arranged at a height of the connection between the first leg and the second leg, the partition wall being configured to extend radially over the intermediate region of the impeller blades that adjoins the radially outer end region.

6. The side-channel blower as recited in claim 1, wherein, the radial gap is arranged between the radially outer end region of the impeller blades and the housing wall, the radial gap radially surrounds the impeller, and the radial gap is 0.03 to 0.1 times a diameter of the impeller in a region of the two flow channels.

7. The side-channel blower as recited in claim 1, wherein, the two flow channels comprise a cross section, and the outlet is configured to extend tangentially from each of the two flow channels in the flow housing and to comprise a circular cross section which substantially corresponds to the cross section of the two flow channels.

* * * * *